United States Patent [19]

Perobelli et al.

[11] 4,277,060

[45] Jul. 7, 1981

[54] METHOD OF FORMING A PACKET OF SIGNATURES AND STACKER FOR IMPLEMENTING SAID METHOD

[75] Inventors: Aldo Perobelli; Giorgio Pessina, both of Paderno Dugnano, Italy

[73] Assignee: Messrs. O.M.G. Officina macchine Grafiche de pessina e Perobelli, Paderno Dugnano, Italy

[21] Appl. No.: 75,586

[22] Filed: Sep. 14, 1979

[30] Foreign Application Priority Data

Nov. 21, 1978 [IT] Italy ..... 29983 A/78

[51] Int. Cl.[3] ..... B65H 29/00

[52] U.S. Cl. ..... 271/186; 271/199; 271/212

[58] Field of Search ..... 271/186, 199, 212, 176

[56] References Cited

U.S. PATENT DOCUMENTS

| | | | |
|---|---|---|---|
| 3,436,073 | 4/1969 | Christmas | 271/186 |
| 3,659,699 | 5/1972 | Donahue | 271/186 X |
| 3,781,005 | 12/1973 | Stobb | 271/186 |
| 4,204,671 | 5/1980 | Pessina | 271/186 |

*Primary Examiner*—Richard A. Schacher
*Attorney, Agent, or Firm*—Kalish & Gilster

[57] ABSTRACT

A method of forming a packet of signatures is proposed, comprising a known step of depositing onto the feeding belt of the stacker signatures from the folding machine, and which includes a transport step of the groups of overlapping signatures to a stacking station, a step during which the presence or absence of signatures is detected upstream of the stacking station, with the issuing of a control signal active on detent means for the stacking, and a stacking step with a following step of removal of said detent means and a step of removal of the formed stack. It is, preferably, also included a step of detecting the presence or absence of signatures downstream of the stacking station, with the issuing of a corresponding control signal active on the stacking detent means. The stacker implementing said method comprises a stacking station, stacking detent means movable to a stacking station, or detent position, and away therefrom, sensor means for detecting the presence or absence of signatures upstream of the stacking station, as well as sensor means for detecting the presence or absence of signatures downstream of the stacking station.

10 Claims, 2 Drawing Figures

METHOD OF FORMING A PACKET OF SIGNATURES AND STACKER FOR IMPLEMENTING SAID METHOD

BACKGROUND OF THE INVENTION

This invention relates to a method of forming a packet of signatures, as well as to a stacker for implementing said method.

As is known, in current practice, located downstream of the folding machines employed to form signatures, that is folded sheets, stackers are provided which serve the purpose of forming packets of such signatures, the latter being arranged to overlap one another and fed in succession from said folding machine.

Conventional stackers comprise essentially a feeding conveyor belt, partially wound around a drum to overlie a signature guiding belt, both belts being formed by a plurality of narrow belts arranged to be coplanar and mutually spaced apart.

The transport of the groups of overlapping signatures occurs through forcibly guiding them by the entraining cooperative action between the feeding or advancing belt for the signatures and the supporting belt therefor, as they are moved away from the cited drum. In current practice, the packets or stacks of signatures are formed through a manual process. However, this is obviously disadvantageous in that, on one hand, high stacking rates cannot be achieved, while on the other hand, the continued presence of an operator becomes necessary, which all adversely affects the manufacturing costs.

OBJECTS OF THE INVENTION

This invention sets out to obviate the drawbacks and inconvenience mentioned above by providing a method of forming stacks of signatures which affords a fully automated type of operation, as well as to provide a stacker implementing such a method.

Within that general aim, it is possible to arrange that high operation rates can be achieved advantageously, as well as the formation of faultless signature stacks.

SUMMARY OF THE INVENTION

Based upon a method of conventional type, which comprises a step of depositing onto the feeding belt of the stacker the signatures from the folding machine, the method of this invention is characterized in that it comprises the following steps, in part already known to some extent:

(a) a transport step of the groups of signatures in overlapping arrangement to a stacking station;

(b) a step during which the presence or absence of signatures is detected upstream of the stacking station, with the issueing of a control signal active on detent means for the stacking;

(c) a stacking step proper of the stack formed by the signatures of one or more groups of signatures;

(d) a step of removal of said detent means;

(e) a step of removal of the formed stack;

(f) an optional, but preferably included, step of detecting the presence or absence of signatures downstream of the stacking station, with the issueing of a corresponding control signal active on the stacking detent means.

Advantageously, in the method of this invention, the sensors for detecting the presence or absence of signatures upstream of the stacking station and active on the stacking means determine the condition of detented positioning of the stacking means as the presence of signatures is detected, preferably simultaneously with the consent to the detented positioning of the same by the sensors intended for detecting the presence or absence of the signatures, or packet thereof, downstream of the stacking station.

Furthermore, it is possible to arrange for the sensors located upstream of the stacking station to determine the removal condition of the positioning detents upon detection of the lack of signatures, preferably simultaneously with a similar determination of the removal condition of the stacking detents as performed by the sensors located downstream of the stacking station.

Advantageously, moreover, in the method of this invention, the stacker is only allowed to operate in the presence of signatures onto the feeding belts of the stacker, that is in the presence of the operative pulse from the signature counter of the folding machine located upstream, the machine being stopped if the same is lacking after a presettable time.

According to another aspect of this invention, there is provided a stacker for signatures fed in groups and arranged in overlapping relationship to one another, comprising a feeding belt partially wound around a drum in overlying relationship with a belt for guiding the signatures and transporting the formed stacks, characterized in that it comprises a stacking station, stacking detent means movable to a stacking station, or detent position, and away therefrom, sensor means for detecting the presence or absence of signatures upstream of the stacking station, as well as sensor means for detecting the presence or absence of signatures downstream of the stacking station.

The cited sensor means for detecting the presence or absence of signatures upstream and downstream of the stacking station, comprise advantageously either microswitch, photocell, capacitive, or the like sensors.

According to a further aspect of this invention, in order to allow packets of signatures to be formed having different length dimensions, there are provided in the stacker detent means associated, either directly or indirectly, with horizontal plane transport and position locating means.

Moreover, according to yet another aspect of the invention, said sensor means may comprise a rack projecting vertically upwards from the belts forming the stack transporting belt, the same being associated with displacing means acting in a vertical plane, preferably of the air-operated or pneumatic type.

BRIEF DESCRIPTION OF THE DRAWINGS

Further advantages, features, and details of the method according to this invention, as well as of the stacker implementing it, will become more clearly apparent from the following description, when referred to the accompanying drawings, where.

DESCRIPTION OF THE PREFERRED EMBODIMENT

Figure 1:
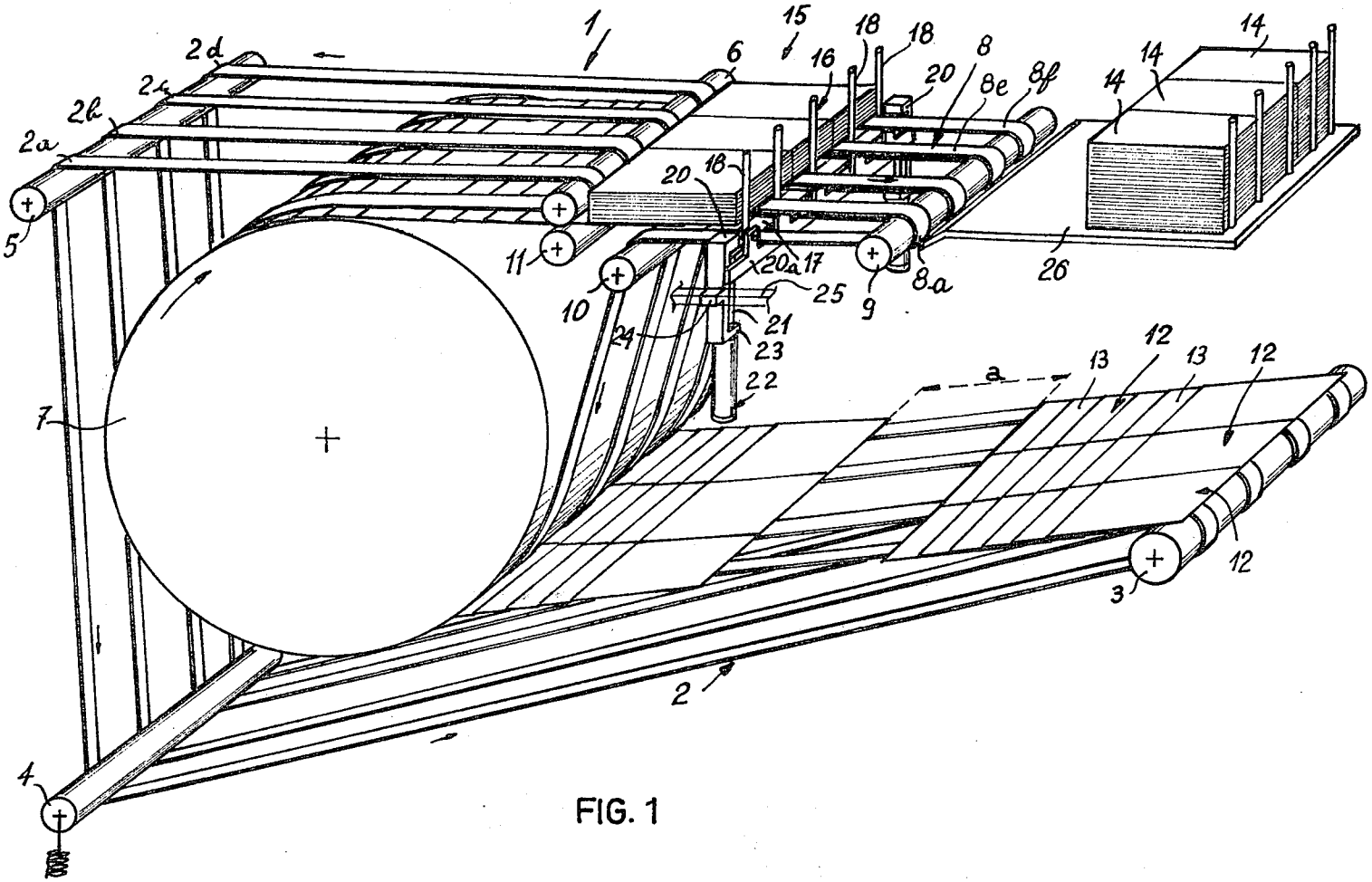
FIG. 1 shows a perspective view of the essential parts of the stacker of this invention, as required to explain the operation thereof.
Figure 2:
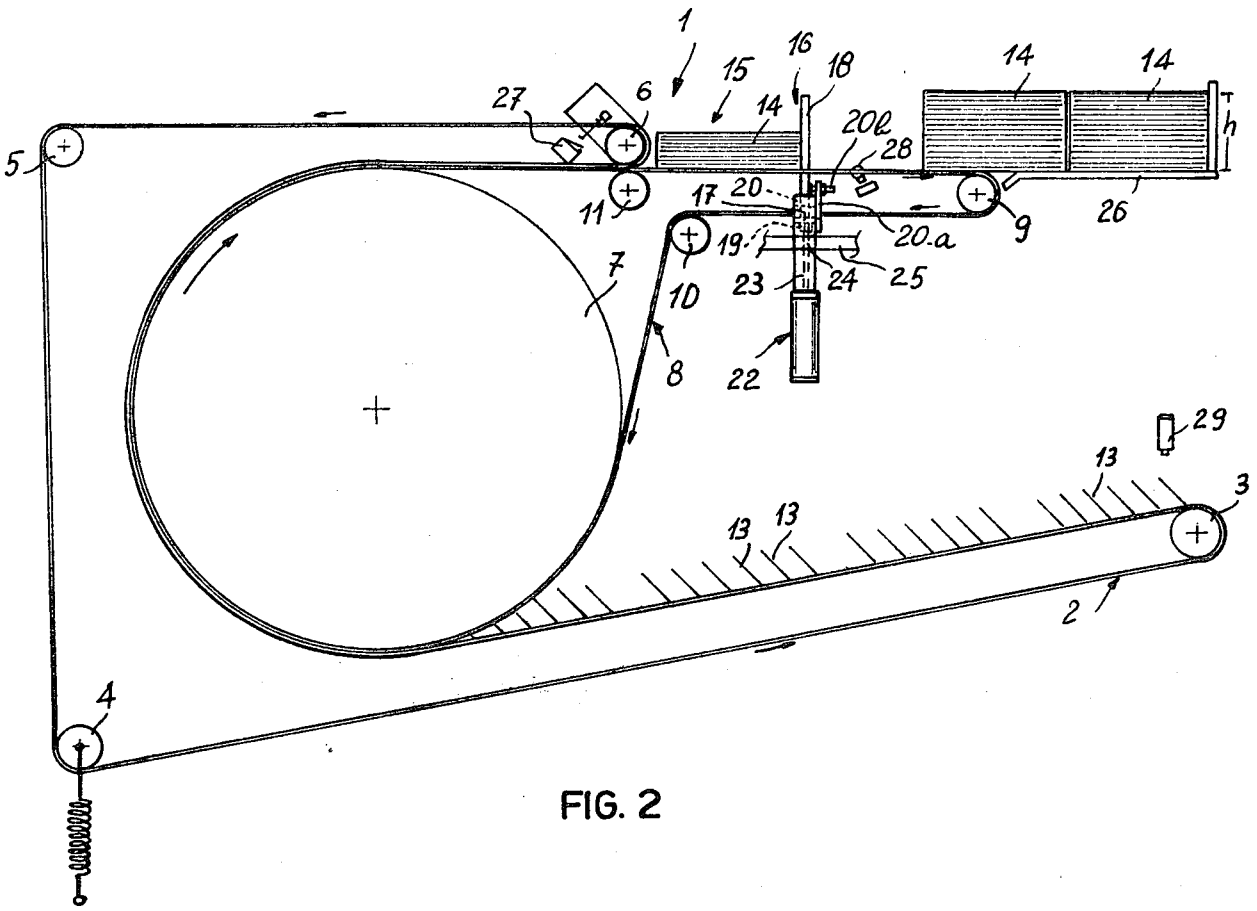
FIG. 2 as a front elevation view of the same.

With reference to the drawing figures, wherein similar parts are denoted with the same reference numerals, the stacker of this invention is indicated generally at 1. It comprises, in a manner known per se, a feeding belt 2 formed by plural, in this example four, individual belts 2a,2b,2c,2d, which are contained in the same plane and spaced mutually apart. Such belts are passed over cylinders 3,4,5,6, and around the drum 7, substantially over the left-hand half-circumference thereof. The numeral 8 denotes a guiding belt for the signatures, which also comprises a plurality (e.g. six) of individual belts 8a–8f, spaced apart from one another. Such belts are passed over cylinders 9,10,11, and are similarly wound around the drum 7.

As can be seen in the drawings, around the drum 7 the belt 8 is wound first, followed by the belt 2 overlying it, between the belts 2,8 there being clamped and forcibly carried onwards about the drum 7 groups 12 of individual signatures 13. In the example being considered, each group 12 comprises six signatures 13 arranged in overlapping relationship.

There is indicated at a the distance from the leading edge of a group 12 and the trailing edge of a group 12 preceding the signatures 13. At h, is indicated the height of a signature stack. In the example shown, three groups 12 of signatures have been taken into consideration, which result accordingly in three stacks 14 of signatures.

The numeral 15 denotes a stacking station, which is defined at the detent area by stacking detent means indicated at 16. In the example being considered, said means include a rack portion, which has a crosspiece 17 provided with a plurality of rods 18 extending upwardly. Said crosspiece 17 is associated with one end at 19, by threaded engagement with the free end of a piston rod 21 of a cylinder-piston unit 22, preferably of the air-operated or pneumatic type, said crosspiece 17 being connected with its other end to the free end of the piston rod (not shown) to a further cylinder-piston unit similar to the former, through a plug member which is movable within a slot. Thus, the rods 18 are allowed a movement in a direction to some extent deviating from the vertical.

At 23, there is indicated a terminating element for supporting the cylinder-piston units 22 and formed with a lug 24, the same having a purposely shaped profile adapted for sliding engagement with a correspondingly mated profile, shown schematically in the drawings at 25, which is provided on the stacker frame. Thus, it becomes possible to move the rack 17 in a horizontal plane to form stacks of signatures 13 having different lengths. The attachment positioning of the supports 24 in the guides 25 is effected in a known manner, not shown, e.g. by means of screw fasteners. The numeral 20 denotes a detent for the height travel of the crosspiece 17, whilst 20a denotes a crosspiece accommodating in an adjustable manner and by threaded engagement horizontal detent rods 20b of the rods 18. At 26, there is indicated a surface for receiving the formed stacks 14. At 27 and 28, there are indicated sensor means for detecting the presence of absence of signatures 13, respectively upstream and downstream of the stacking station 15. The operation of the same will be explained hereinafter in connection with the method according to the invention.

The reference numeral 29 denotes a photocell provided, in accordance with this invention, for detecting the presence of signatures 13 at the beginning of the belt 2 of the stacker, the same cooperating also with the signature counter of the feeding folding machine, not shown.

The method according to this invention is carried out as follows. When signatures are lacking both upstream and downstream of the detent means 16, the latter are at their lowered position because the absence of signatures at the sensor 27 causes the rack 16 to be lowered. As the first group 12 of signatures moves with its edge past the sensor 27 above it, the same emits a pulse to raise the rack 16, which is raised as a result of the absence of signatures at the sensor 28. Consequently, the cited signature group continues its movement, the signatures abutting on the rods 18 of the rack 16 to form a stack of signatures 14. As the trailing edge of said signature group moves past the sensor 27, above it, and then leaves it, the sensor 27 emits a pulse to lower the rack 16. Thus, the belt 8 causes the stack 14 of signatures to advance along the surface 26.

As the trailing edge of the packet 14 moves past the sensor 28, the latter emits a pulse effective to hold the rack lowered until the trailing edge of the packet 14 has moved past the sensor 28. Then the rack 16 is raised as a result of the control pulse emitted by the sensor 27, in response to the passage of the following group of signatures, which raising is also consented to by a similar pulse from the sensor 28 detecting the absence of signatures 13.

Then the cycle is repeated over again.

Good results have been obtained by using for the sensors 27 and 28, respectively a microswitch and a photocell, the circuits whereof, similarly to the preferably air-operated circuit of the cylinder-piston units 22, are not shown because well within the capabilities of an expert in the art.

It will be appreciated from the foregoing that the instant method of forming signature stacks automatically, and the stacker according to the invention, effectively achieve the objects mentioned hereinabove and secure the advantages listed, in particular a fully automated operation, a type of operation that require no operator, and a high stacking rate.

In practicing the invention, individual components may be replaced with other technically equivalent ones. For example, signature feeding and supporting belts may be provided in numbers and/or widths which differ from those indicated, or following a different profile path, or detent means configurated other than indicated hereinabove; or to provide for such detent means shifting, e.g. by rotation, or sensors of a different type from those indicated, etc., without departing from the scope of this invention.

It will be appreciated, moreover, that the method, or the stacker, according to the invention affords the possibility of producing signature stacks comprising any selected number and size of such signatures; in the exemplary embodiment discussed, the distance a between consecutive groups of signatures being selected to have a minimum value such as to only allow for the response times of the movable detent means each time provided.

Furthermore, in accordance with this invention, if the downstream sensor 29 is omitted for simplicity, the distance shall have to be greater than the length of a signature, such as to avoid that the successive group of signatures may prevent the sensor 27 from enabling the lowering movement of the rack 16.

By providing of preference, according to the invention, and advantageously, a photocell type of sensor 29, the stacker is enabled to operate, namely to rotate, only in the presence of signatures onto the stacker transport belts, or in the presence of the actuating pulse from the signature counter of the folding machine; in the absence whereof, the machine being stopped after a preset time lapse.

As mentioned in the foregoing, the arrangement of the circuits of the sensors and cylinder-piston units is not explained in detail, as is the actuation of the stacker, because the same are well within the capabilities of an expert in the art, or can be accomplished with parts and components known per se.

All of the features that may be inferred from this specifications, from the appended claims and accompanying drawings, are substantial to the invention, either individually or in any combination thereof, even when the same are not expressly claimed in the appended claims.

We claim:

1. A method of forming a packet of signatures including the step of depositing onto a feeding belt of a stacker signatures from a folding machine, characterized in that said method comprises:

(a) the step of transporting groups of said signatures in overlapping arrangement to a stacking station including detent means selectively movable to and from a stacking position;

(b) the step of detecting the presence or absence of signatures upstream of said stacking station by upstream sensor means, and issuing a corresponding control signal to said detent means for movement thereof to said stacking position upon detection of the presence of signatures upstream of said stacking station;

(c) the step of forming a stack of said signatures by feeding of said signatures carried by said belt against detent means, while said detent means is in said stacking position;

(d) the step of moving said detent means from said stacking position after a stack is formed to permit a formed stack to be carried downstream from said stacking station;

(e) the step of carrying a formed stack of said signatures downstream from said stacking station, and (f) the step of detecting the presence or absence of signatures downstream from said stacking station by downstream sensor means, and issuing a corresponding control signal for controlling movement of said detent means into said stacking position.

2. A method according to claim 1 and further comprising the step of preventing said upstream sensor means from causing said detent means to be raised to stacking position unless the absence of signatures is sensed by said downstream sensor means.

3. A method according to claim 1 or 2 wherein said upstream sensor means detects the absence of signatures upstream from said stacking station, for determining movement of said detent means from said stacking position, upon simultaneous signalling by said downstream sensor means of the absense of signatures downstream of said stacking station.

4. A method according to claim 1 including the step of preventing said stacker from operating in the absence of signatures being deposited onto said feeding belt.

5. A stacker for signatures fed in groups and arranged in overlapping relationship to one another, comprising a feeding belt partially wound around a drum in overlying relationship with a stack forming and transporting belt for guiding the signatures and transporting the formed stacks, characterized in that it comprises a stacking station, stacking detent means movable to a stacking position, and away therefrom, sensor means for detecting the presence or absence of signatures upstream of the stacking station, and sensor means for detecting the presence or absence of signatures downstream of the stacking station.

6. A stacker according to claim 5 characterized in that said stacking detent means comprises a rack having a plurality of teeth provided with adjustable horizontal detents projecting vertically upward from the belt elements forming said stack forming and transporting belt, drive means associated with said rack for reciprocation of said rack in a vertical plane and horizontal plane transport and position locating means for said rack.

7. A stacker according to claim 6 wherein said drive means for reciprocation of said rack in a vertical plane comprises a plurality of cylinder-piston units each having a rod associated with a crosspiece of said rack and interconnected therewith for allowing for raising and lowering of said rack along a line deviating slightly from vertical.

8. A stacker according to claim 6 wherein said rack horizontal plane transport and position locating means comprise profile lugs provided on supports thereof and engaging complementarily profiled guides provided on the machine frame, the position locating means comprising screw fastener means.

9. A stacker according to claim 5 wherein said sensor means for detecting the presence or absence of signatures upstream and downstream of the stacking station each comprise microswitches.

10. A stacker according to claim 5 further comprising a photocell operative to detect the presence or absence of signatures at the initial portion of said feeding belt, said photocell enabling said stacker to operate only in the detected presence of signatures on said initial portion of said feeding belt.

* * * * *